US010424879B2

(12) United States Patent
Vogel et al.

(10) Patent No.: US 10,424,879 B2
(45) Date of Patent: Sep. 24, 2019

(54) HYBRID PLUG CONNECTOR

(71) Applicants: BECKHOFF AUTOMATION GMBH, Verl (DE); CONEC ELEKTRONISCHE BAUELEMENTE GMBH, Lippstadt (DE)

(72) Inventors: Florian Vogel, Bielefeld (DE); Thomas Rettig, Rheda-Wiedenbrück (DE); Dirk Bechtel, Bielefeld (DE); Werner Schmidt, Halver (DE); Christian Schramm, Lippstadt (DE)

(73) Assignees: BECKHOFF AUTOMATION GMBH, Verl (DE); CONEC ELEKTRONISCHE BAUELEMENTE GMBH, Lippstadt (DE)

( * ) Notice: Subject to any disclaimer, the term of this patent is extended or adjusted under 35 U.S.C. 154(b) by 0 days.

(21) Appl. No.: 15/773,178

(22) PCT Filed: Oct. 28, 2016

(86) PCT No.: PCT/EP2016/076162
§ 371 (c)(1),
(2) Date: May 3, 2018

(87) PCT Pub. No.: WO2017/076781
PCT Pub. Date: May 11, 2017

(65) Prior Publication Data

US 2018/0323549 A1 Nov. 8, 2018

(30) Foreign Application Priority Data

Nov. 6, 2015 (DE) ..... 10 2015 119 087

(51) Int. Cl.
*H01R 13/6592* (2011.01)
*H01R 13/514* (2006.01)
(Continued)

(52) U.S. Cl.
CPC ..... *H01R 13/6592* (2013.01); *H01R 13/514* (2013.01); *H01R 13/582* (2013.01);
(Continued)

(58) Field of Classification Search
CPC ..... H01R 13/6592; H01R 9/035; H01R 13/6453; H01R 13/59
(Continued)

(56) References Cited

U.S. PATENT DOCUMENTS 3,491,330 A * 1/1970 Barnhart ..... H01R 13/6453 439/681
4,820,204 A * 4/1989 Batty ..... H01R 13/514 439/681
(Continued)

FOREIGN PATENT DOCUMENTS

DE 202006019107 U1 2/2007
DE 202006019107 * 3/2007
(Continued)

OTHER PUBLICATIONS

International Search Report (dated Feb. 2, 2017) for corresponding International App. PCT/EP2016/076162.

*Primary Examiner* — Tulsidas C Patel
*Assistant Examiner* — Peter G Leigh
(74) *Attorney, Agent, or Firm* — WRB-IP LLP

(57) ABSTRACT

Hybrid plug connectors are provided for connecting different electronic modules to insulators arranged in an outer casing and for receiving a power conductor transmitting a power supply and a shielded data conductor for data transmission for transmitting signals/data of an industrial bus,
(Continued)

such as ISA, ethernet or similar, wherein the power conductor has at least two power lines and the data conductor has at least one data line, wherein the power lines and the data lines are guided in contact parts designed as plugs or sockets and can be coupled via these contacts parts, and wherein the outer casings of the pair-type hybrid plug connectors can be joined inside one another for interlocking coupling. The insulator arranged in each of the plug connectors can be arranged in a shield housing as a contact carrier receiving arrangement, the shield housing accommodating a contact carrier, which carries forward the data line(s) designed as plug sockets or plug pins in a shielded manner in the plug connector, and wherein the coupleable contacts form a shape-encoded interlocking connection in the plugged-in state of the connection.

12 Claims, 6 Drawing Sheets

(51) Int. Cl.
*H01R 13/58* (2006.01)
*H01R 13/642* (2006.01)
*H01R 24/86* (2011.01)
*H01R 103/00* (2006.01)

(52) U.S. Cl.
CPC ..... *H01R 13/642* (2013.01); *H01R 24/86* (2013.01); *H01R 2103/00* (2013.01)

(58) Field of Classification Search
USPC ..... 439/607.41
See application file for complete search history.

(56) References Cited

U.S. PATENT DOCUMENTS 5,222,909 A * 6/1993 Nomura ..... H01R 13/6582 439/271
5,362,261 A * 11/1994 Puerner ..... H01R 13/4364 439/689
5,876,248 A * 3/1999 Brunker ..... H01R 13/6582 439/607.08
6,425,776 B1 7/2002 Fredl
6,447,320 B1 9/2002 Scholler
6,595,801 B1 * 7/2003 Leonard ..... H01R 13/6485 439/607.55
6,746,284 B1 6/2004 Spink, Jr.
6,872,100 B2 * 3/2005 Correll ..... H01R 13/4367 439/752
6,945,817 B2 * 9/2005 Miyazaki ..... H01R 9/0521 439/578
7,306,472 B2 * 12/2007 Matsumoto ..... H01R 13/6273 439/314
7,371,124 B2 * 5/2008 Khemakhem ..... H01P 1/045 439/668
7,682,191 B2 * 3/2010 Iwahori ..... H01R 13/4365 439/595
7,931,496 B2 * 4/2011 Ushiro ..... H01R 13/743 439/353
8,075,350 B2 * 12/2011 Heggemann ..... H01R 13/6453 439/680
8,905,790 B2 * 12/2014 Staudigel ..... H01R 13/50 439/638
9,583,879 B2 * 2/2017 Krome ..... B60L 11/1818
2006/0035513 A1 2/2006 Yohn et al.
2013/0164986 A1 * 6/2013 Staudigel ..... H01R 13/514 439/626
2014/0162488 A1 * 6/2014 Staudigel ..... H01R 9/03 439/372

FOREIGN PATENT DOCUMENTS

DE 202008013757 U1 3/2010
DE 102010035868 B3 2/2012
EP 1102097 A2 5/2001
EP 1936752 A2 6/2008
EP 2112722 A1 10/2009
EP 2390960 A2 11/2011
WO 2010047716 A1 4/2010
WO 2012069865 A1 5/2012

* cited by examiner

100'
100''
100'''
122
117

HYBRID PLUG CONNECTOR

BACKGROUND AND SUMMARY

The invention relates to a hybrid plug connector for connecting conductor cables of different electronic modules to insulator bodies arranged in an outer casing for receiving a power conductor transmitting a power supply and a shielded data conductor for data transmission for transmitting signals/data of an industrial bus, such as ISA, Ethernet, or the like, wherein the power conductor has at least two power lines and the data conductor has at least one data line, wherein the power lines and the data lines are guided in contact parts designed as plugs or sockets and can be coupled via these contacts parts, and wherein the outer casings of the hybrid plug connectors can be joined inside one another for interlocking coupling, and wherein an insulator body designed as a contact carrier receiving means is arranged in each of the plug connectors designed as sockets and plugs, having a contact carrier in a shield housing, said shield housing accommodating a contact carrier which carries forward the data line(s) designed as plug sockets or plug pins in a shielded manner in the plug connector designed as socket or plug, and wherein the couplable contacts form a shape-encoded interlocking connection in the plugged-in state of the connection.

Hybrid plug connectors are known as devices in which electronic modules of the most varied kinds can be electrically coupled with respective plug connectors, wherein both power supply and data transmission functionality can be carried via the plug connectors which can be joined as pairs. Such hybrid plug connectors are for example used in manufacturing plants for coupling or uncoupling complex cable connections between control devices or control cabinets and machine tools, wherein preferably multiple control and supply lines are joined in one shielded cable. The shields required for interference-free operation may not experience degradation at transition points such as plugs or sockets.

Therefore, these are covered by screw caps as described in DE 20 2005 010 113 U1, such that shielding is ensured. EP 1 936 752 B1 discloses modular round plug connections with transmission jobs such as power supply and/or signal transmissions, in which two coupling parts to be connected comprise radially projecting cams axially on both sides in the region of their inner edges for unique mapping. Furthermore, round plug connectors are known as electrical line connections, for example from German utility models 299 15 382 U1 and 299 15 381 U1. WO 2000/45469 A1 discloses an electrical connector in which the sleeve that connects the two coupling parts is designed as one piece. A similar coupling with a one-piece sleeve is known from U.S. Pat. No. 6,454,576 B1. Other disclosures are contained in U.S. Pat. No. 6,746,284 B1 and in WO 2010/047 716 A1. EP 2 390 960 B1 discloses an electric connector having a connector housing with at least one contact cavity and one interchange port, a contact held by the connector housing in the contact cavity, and an interchangeable signal module separably mounted to the connector housing, such that at least a portion of the signal module is held in the interchange port of the connector housing, wherein the signal module comprises an insulator holding a contact.

Particularly, DE 20 2008 013 757 U1 describes such a hybrid plug connector having a round metal housing with a contact insert, which comprises contacts for the data and power line to be connected, which contacts are configured as plug sockets or plug pins or as OWG terminals, wherein a shielded industrial bus (PDP, Ethernet . . . ) or an OWG conductor is provided as data line and an at least two-pole, preferably three or four-pole line is provided for transmitting a power supply.

The sizes of the contact parts—plug sockets/plug pins—determine the required diameter of the plug housing, among other parameters. While this configuration facilitates the manufacturing of plug connectors which meet the electrical requirements plug connectors have to meet, their dimensions prevent desired miniaturization. To further develop such plug connectors to allow further miniaturization while keeping manufacturing economical, the data contacts for the data lines, which contacts are designed as plug sockets or plug pins, are eccentrically disposed in the plug housing and surrounded by at least two power contacts disposed concentrically with the plug housing and in a circular arc partially encompassing the data insert and designed as plug socket or plug pin. The eccentric arrangement ensures a unique seating when assembling the pair-type hybrid plug connectors, wherein the shielding of the signal line of the industrial bus remains consistently intact. Assembling and incorporating the lines into the hybrid plug connectors and providing continuous uninterrupted shielding can be problematic in this respect. This is all the more true as continuous shielding is achieved for such plug connectors in that the shielding, when installed to size, which requires initial unraveling of the wire mesh in the case of a shielding braid, needs a metal extension to bridge the shielding. If individual wires stick out after unraveling, this can result in contact closing and failure of the plug connector. Another problem of unraveling is that individual wires are tom off, and effective shielding is no longer provided when a plug has been assembled. This means that, with the known sleeves, it is difficult to achieve continuous and all-round shielding on the one hand, and there are problems with strain relief and/or connecting the shield via the shielding sleeve on the other hand. Axial insertion of the shielding braid is a problem, since individual wires can break off and adversely influence shielding. Tensile strain can also result parts of the braid being torn off, causing gaps in the shielding.

Problem

It is therefore desirable to further develop hybrid plug connectors of this type such that their assembly is made easier, manufacturing of the plug connectors is economical, and cut-to-size installation of the line using the plug connectors can easily and safely be done "in situ" while ensuring a 360° shield.

Aspects of the Invention

According to an aspect of the invention, the problem can be solved.

According to an aspect of the invention, it is proposed that the insulator body disposed in each plug connector is arranged as contact carrier receiving means in a shield housing, which accommodates a contact carrier which carries forward the data line(s) designed as plug sockets or plug pins in a shielded manner in the plug connector designed as socket or plug, and wherein the couplable contacts form a shape-encoded interlocking connection in the plugged-in state of the connection. The plug sockets or plug pins of the data lines can be inserted in a positive locking manner in recesses of a contact carrier, which is disposed in a trapezium-shaped contact carrier receiving means, and the contact carrier receiving means is encompassed by a form-fitting shield housing which continues the shielding of the data lines, the free end of which housing is either configured as a shoulder or an overlapping collar for coupling the plug connectors designed as sockets or plugs.

The insulator body disposed in each of the plug connectors is designed as a contact receiving means, which comprises recesses, which contains signal contacts in addition to the power contacts disposed in a contact carrier, which signal contacts are accommodated in a shape-encoded interlocking fit in a contact carrier with recesses housed in a contact carrier receiving means. These contact carriers which carry forward the signal lines of the signal cable in the plug connector form the plug connector pair as plug sockets and plug pins. It is particularly advantageous that the contact carrier receiving means with the contact carrier for the data lines, which are surrounded by a shielding braid, are accommodated in a shield housing. This is because the shield housing is an assembly part and can easily be placed in a strain relieving manner onto the exposed shielding braid area without damaging it.

The plug sockets or plug pins can be inserted with an interlocking fit into the recesses of the contact carriers, wherein undercuts advantageously hold the inserted contacts firmly.

The contact carrier receiving means has a trapezoid shape. This allows a higher packaging density for the power contacts and promotes miniaturization.

A shield housing encompassing the contact carrier receiving means in an interlocking fit and carrying forward the shielding of the data line ensures continuous shielding. Its free end is designed as a shoulder or as an overlapping collar when coupling two plug connectors, wherein both make the electrical connection. Such continuous shielding is ensured in this manner if plug connectors are coupled.

According to a preferred embodiment, the data line is designed to be slid on. In the slid-on state, the shield housing can be clamped onto or above the data line. To simplify assembly, the end of the shield housing facing the signal cable is designed such that the signal line including shielding braid can be laterally inserted after axial insertion of the contact carrier receiving means into the shield housing. This particularly allows easy assembly.

The end of the shield housing facing the signal cable is equipped with a shoulder over which a clamping bracket engages. This clamping bracket is U-shaped, and its free erect limbs comprise latching openings which interact with latching lugs on flanks of the shoulder corresponding to these limbs. After laterally inserting the shielding braid of the signal cable, this clamping bracket is pressed over the shoulder until it snaps in, thus providing strain relief acting on the entire signal cable and establishing electrical contact. This clamp connection can easily be disconnected, such that a line can be installed to size easily, safely and fast using plug connectors, if this has to be done on site. Similarly, this clamp connection allows easy disassembly of the plug connector without damaging the data element. This makes it possible to connect and disconnect the plug connector multiple times.

One of the advantages of the plug connector according to an aspect of the invention is the simple assembly of its components due to the "poka-yoke" principle, which prevents incorrect assembly of the components. The "poka-yoke" principle is characterized in that it includes a principle comprising multiple elements, which comprises technical precautions or installations for immediate error detection and error prevention. In addition, the shielding can be assembled easily and safely with respect to the shielding braid because it is performed through the shield housing as such by laterally inserting and clipping on a shielding plate. Furthermore, an aspect of the invention is characterized by high current-carrying capacity, for example at a strand cross section of 0.34 mm2 and an adjusted contact diameter of 0.8 mm. Other combinations of strand cross section and contact diameter adjusted to it can be implemented, of course. The hybrid plug connector also ensures unambiguous orientation by its exemplary trapezoid shape (poka-yoke), which provides an interlocking fit between the plug socket and the plug pins. Mating areas of plugs and coupling nodes are not slotted, which particularly increases robustness of the plug connection and improves the shield transfer properties.

According to a particularly advantageous embodiment of an aspect of the invention, the hybrid plug connector of an aspect of the invention has a uniform appearance in all sizes due to identical data line connection node, which allows consistent contact arrangements of the power contacts. Despite the high packaging density, all sizes have a high current-carrying capacity with the contact diameters adjusted accordingly. In addition, the correct orientation when connecting the plug and coupling results from aligning the two pointed coding noses and the marking on the bayonet screw. A colored ring on the grip body can be installed to mark the coding. Use of uniform shield housings for all cable diameters is particularly advantageous. Identical contact arrangements are achieved by using identical contact carriers for the extrusion-coated and field-attachable plug connectors. The contact carriers, complete with contacts, are extrusion coated in an injection mold, and the pins are pressed or latched into the preformed contact carrier during assembly.

When the extrusion-coated or field-attachable plug connectors are manufactured, a coding can be selected on the central part of the plug connector by inserting a coding element in one of several grooves.

Various polarities per size of plug connector are available, wherein the customer can select the codings during assembly by inserting coding elements in one of the grooves, and assembly of the components will be without errors due to the "poka-yoke" principle.

The data conductor as such may also include 1, 2, or 3 data lines. It is also possible that more than 4 data lines are arranged in the data conductor, all of which are contacted in the shield housing. The data lines in the data conductor can either be designed as copper lines or as optical conductors (such as optical fibers or synthetic optical fibers). Other conductive materials for data transmission are conceivable.

According to an aspect of the invention, the modular structure of the plug housings preferably allows them to be configured in 4 different designs, without requiring special tools, etc. This results in an additional advantage in that these embodiments provide additional polarity reversal protection, if special applications are intended. For example, 1. data contacts can be designed as plug pins, power contacts can be designed as plug pins, 2. data contacts can be designed as plug sockets, power contacts can be designed as plug sockets, 3. data contacts can be designed as plug pins, power contacts can be designed as plug sockets, and 4. data contacts can be designed as plug sockets, power contacts can be designed as plug pins. If the number of power pins is 2, 3, 4, 5, or 6, an additional polarity reversal protection is or can be installed.

BRIEF DESCRIPTION OF THE DRAWINGS

One embodiment of the present invention is illustrated purely schematically in the drawings and is explained in greater detail below. Wherein:

FIG. 2: shows perspective views of a plug connector (socket parts) with different plug configurations;

FIG. 5: shows perspective views of a detail of the shield housing

DETAILED DESCRIPTION

It will be understood that the respective corresponding plug connectors 200 have identical plug configurations, but with plug pins 222 or 217, respectively. The data conductor, which according to the exemplary embodiment has four data lines, may also include 1, 2, or 3 data lines. It is also possible that more than 4 data lines are arranged in the data conductor, all of which are contacted in the shield housing 125 or 225, respectively.

Figure 1:
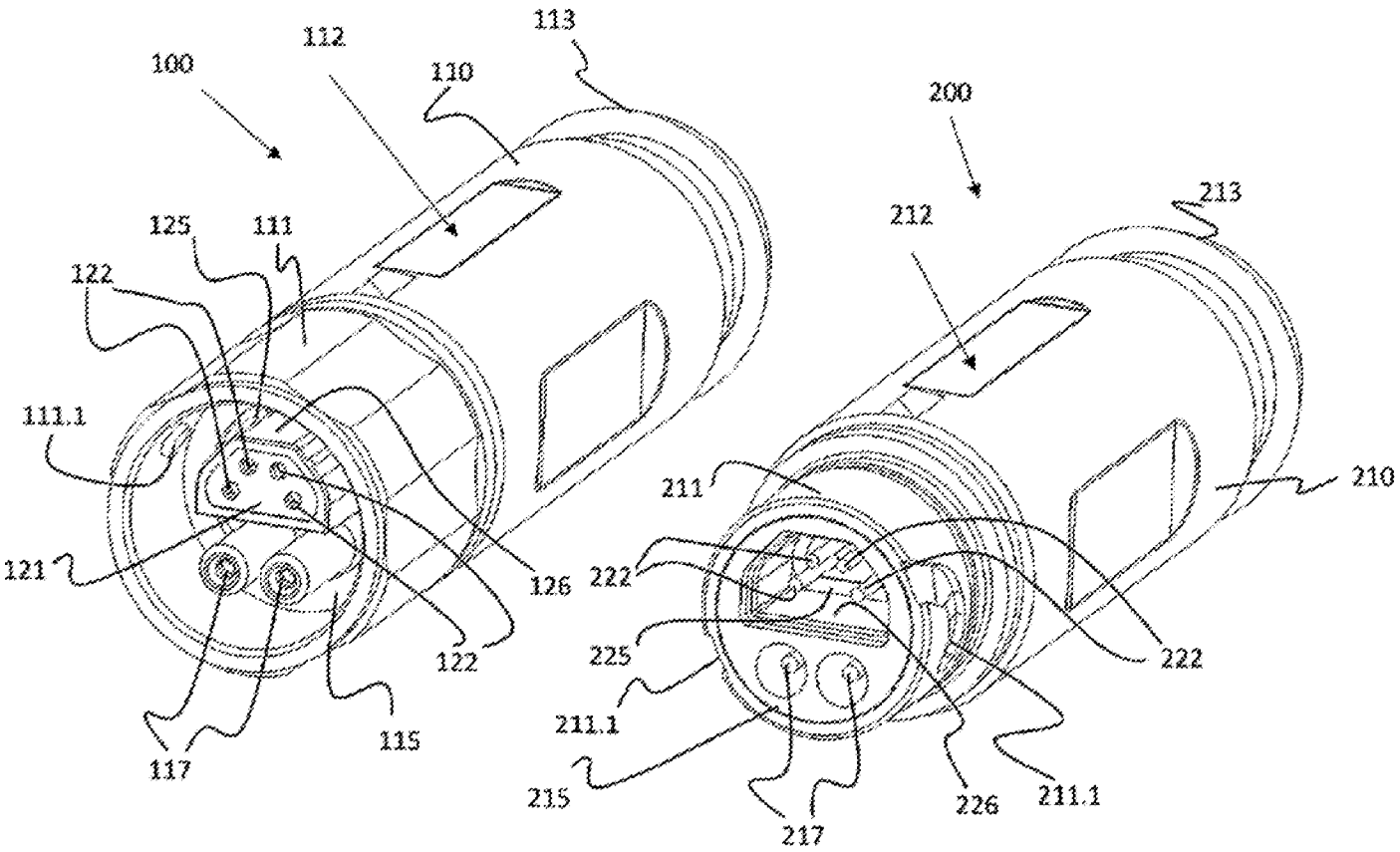
FIG. 1: shows perspective views of a pair of plug connectors.
Figures 2A, 2B, 2C:
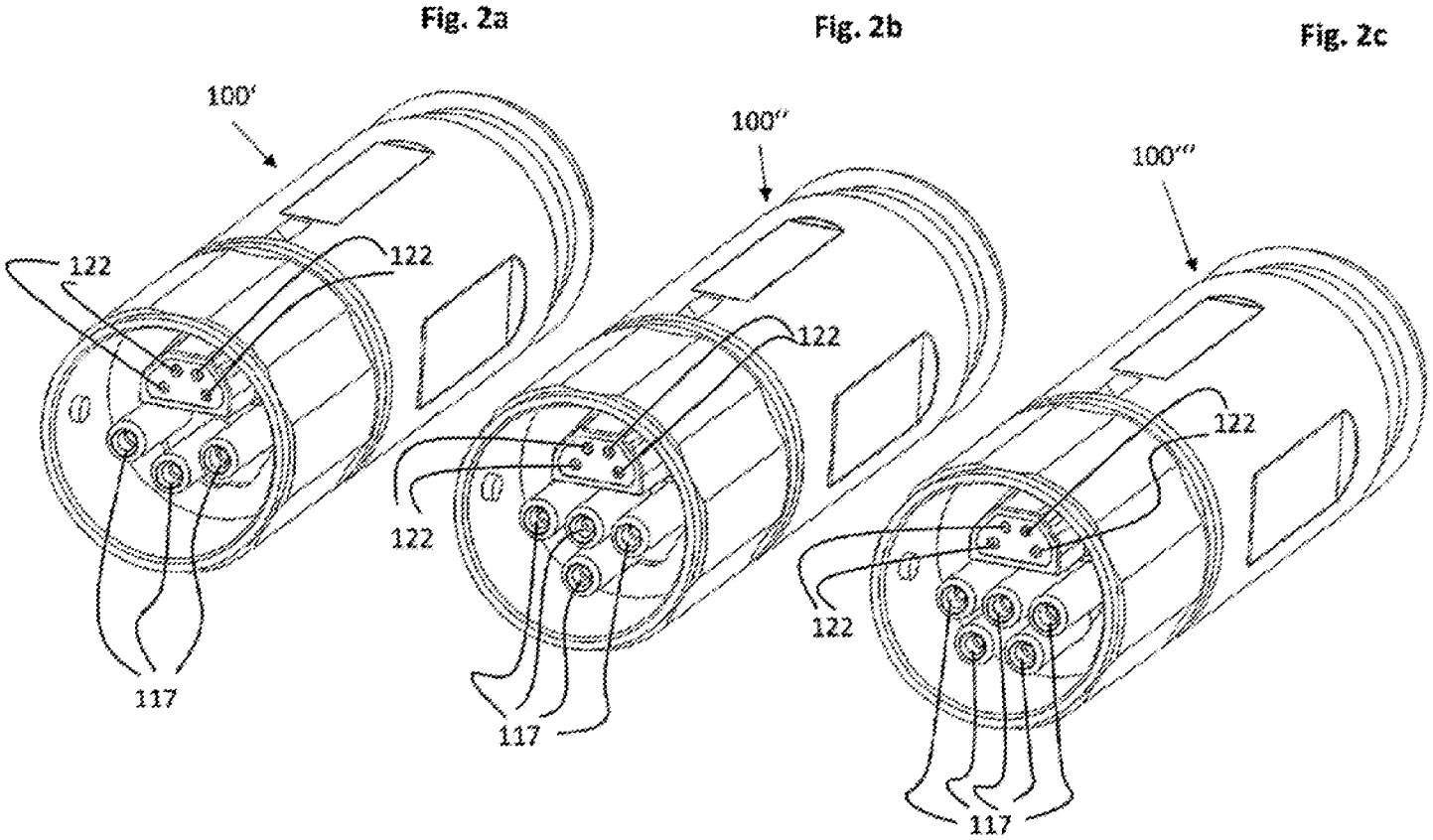
FIG. 2*a*: four data contacts/three power contacts
FIG. 2*b*: four data contacts/four power contacts
FIG. 2*c*: four data contacts/five power contacts
Figure 3:
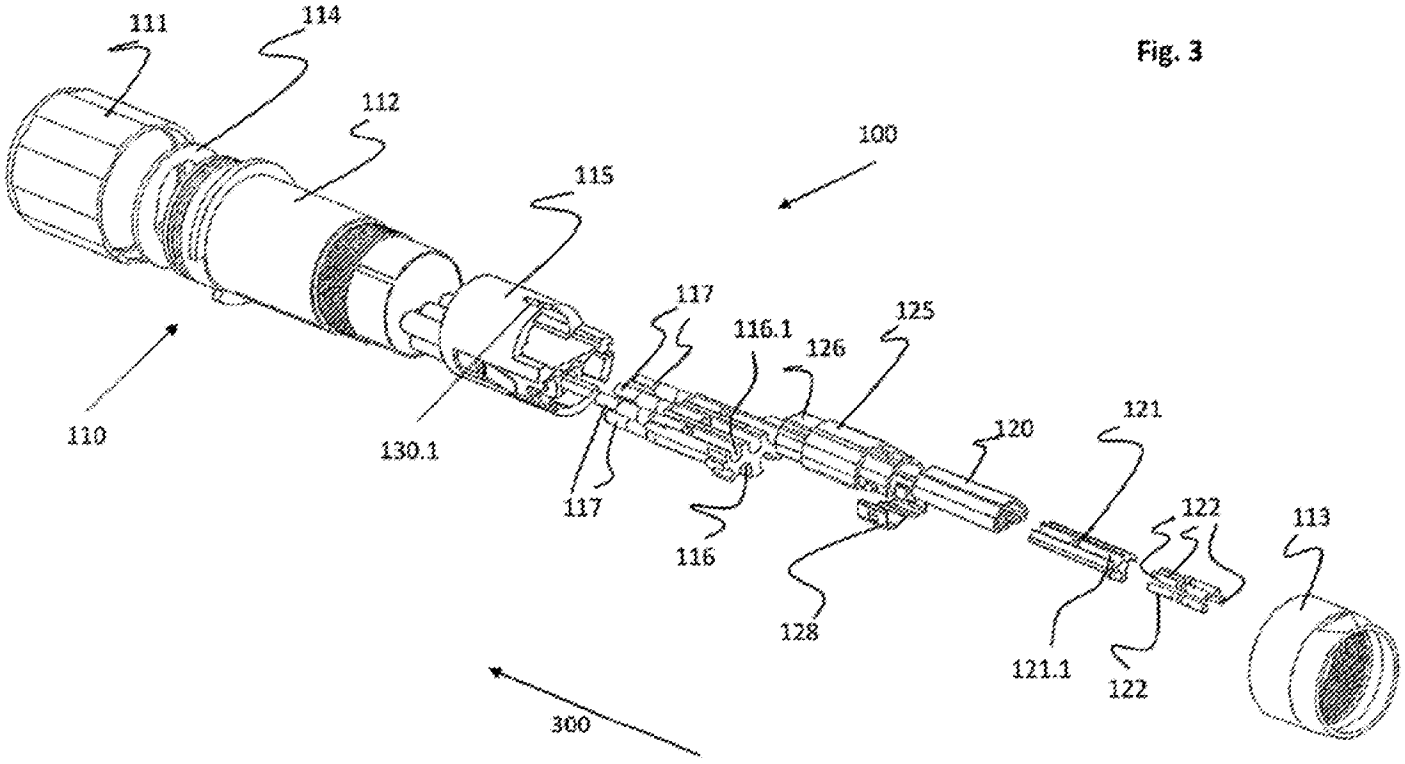
FIG. 3: shows an exploded view of a plug connector, socket part.
Figure 4:
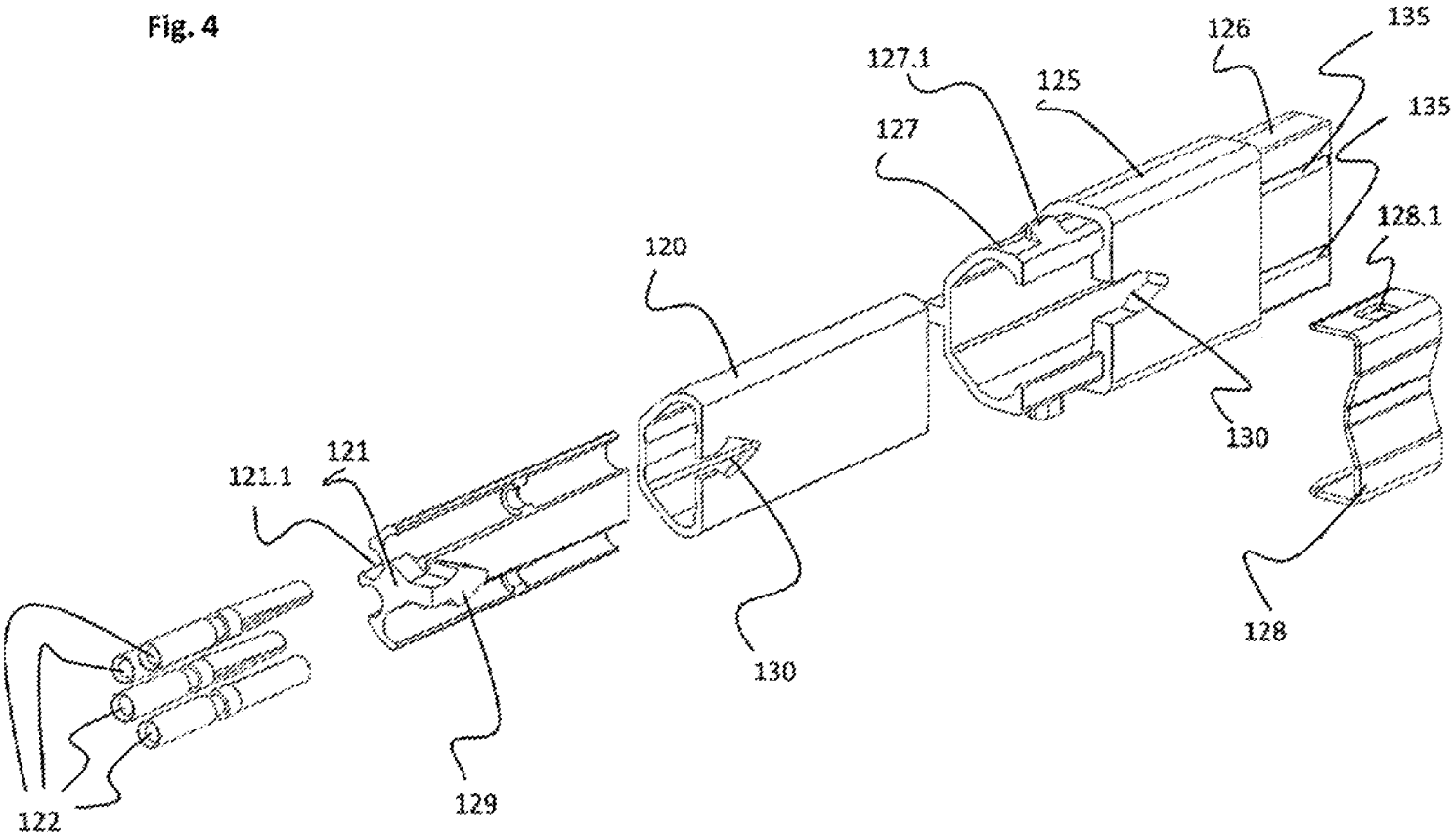
FIG. 4: shows an exploded view of a detail of the shield housing with contact carrier for the data contacts.

FIG. 3, in conjunction with FIG. 4, shows the structure of the plug connector 100' plug sockets 117, wherein it also becomes apparent how the plug connector 100''' is assembled. Structure and assembly apply likewise to the plug connectors 100, 100', 100'', 200, of course. If a cable, which is not shown here, is connected to the plug connector 100''', the five wires of the power line, according to the exemplary embodiment of FIG. 3, should be connected to the plug sockets 117 of the power contacts and be clipped onto the contact carrier 116. such that the contact carrier 116 can be inserted in the contact receiving means 115. For this purpose, the contact carrier 116 comprises recesses 116.1, which accommodate the plug sockets 117 of the power contacts in an interlocking fit, as described. Likewise, the plug sockets 122, after connecting the four wires of the data line, are inserted in the contact carrier 121, which also accommodates these plug sockets 122 in an interlocking fit.

The plug sockets 122 of the data contacts together with the contact carrier 121 are surrounded by a contact carrier receiving means 120, wherein the contact carrier receiving means 120 itself is accommodated by the shield housing 125, which carries forward the cable shielding in the plug connector 100'''. The contact carrier receiving means 120 and the latched shield housing 125 are pushed into each other during assembly together with the contact carrier 121 before they are inserted in the contact receiving means 115. To seal off the elements inserted in the plug connector 100''', a sealing ring 114 is provided, which is disposed in front of the contact receiving means 115 in the central part 112 of the outer casing 110.

In the plug connector 100 with plug sockets 122, the shield housing 125 has a shoulder 126, which allow an interlocking fit when joining two plug connectors 100 and 200 and thus provide secure contact closure of the shielding between the plug connectors 100 and 200. This contact closure is enhanced by the molded-on ribs 135 shown in FIG. 4, which extend in the longitudinal direction and contact the collar 226 of the accordingly shaped shield housing 225 of the other plug connector 200.

For improved visibility, FIG. 4 shows the contact carrier receiving means 120 of the plug connector 100 for the plug sockets 122 of the data contacts, wherein the contact receiving means for the plug connector 200 with plug pins 222 is designed in a corresponding shape. The contact carrier 121, which itself comprises recesses 121.1 in which the data contacts designed as plug sockets 122 can be inserted and held in an interlocking fit, can be inserted in this contact carrier receiving means 120.

The contact carrier 121 equipped in this manner is inserted into the contact carrier receiving means 120 in fixed with a locking lug 129 in the shape of an arrow in a matching recess 130. As can be seen in the figures, the contact carrier receiving means 120 is designed as a hollow body with a trapezoid cross section, wherein the cavity has such a cross section that the contact carrier 121 equipped with plug sockets 122 can be inserted with an interlocking fit. It is self-evident that the respective means for the plug connector 200 with plug pins 222 are designed correspondingly.

The shield housing 125, which accommodates the contact carrier receiving means 120 with the contact carrier 121 equipped with plug sockets 122 is provided for continuous shielding of the data conductor. This shield housing 125 advantageously has a trapezoid cross section as well, such that the contact carrier receiving means 120 can be inserted with an interlocking fit. The free end of the shield housing 125 is designed as a shoulder 126 for plug connectors 100 with plug sockets 122, while the free end of the shield housing 225 for plug connectors 200 with plug pins 222 forms a collar 226 which engages over the shoulder 126. When joining a plug connector 100 and a plug connector 200, the collar 226 engages over the shoulder 126. An interlocking fit ensures good contact-making. This results in an optimum shielding effect, enhanced by the molded-on ribs 135.

Figure 5B:
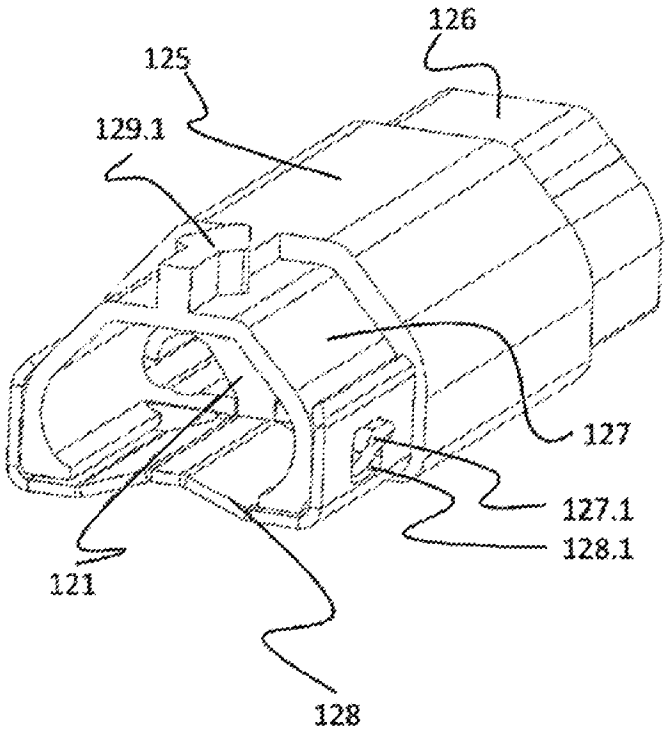
FIG. 5*b* Shield housing closed.
Figure 5A:
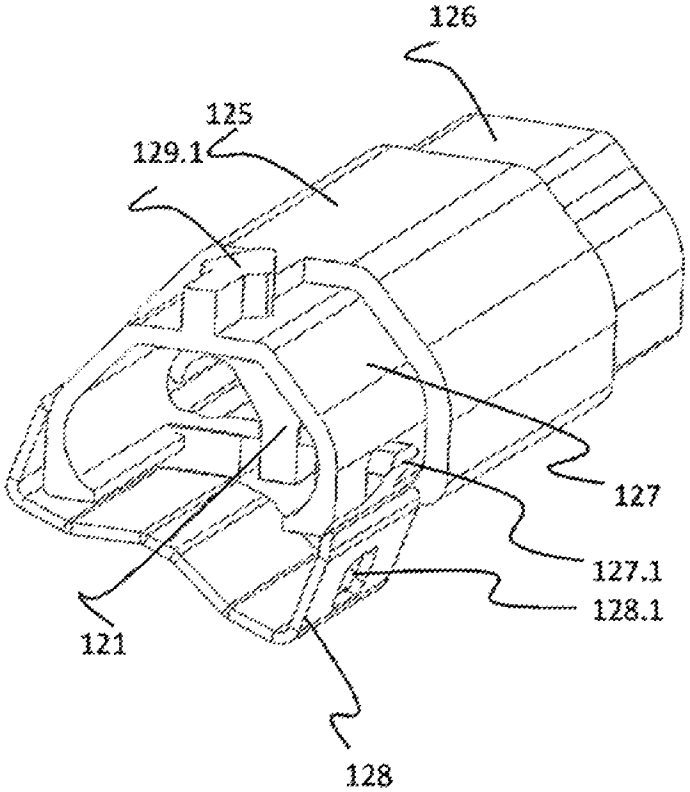
FIG. 5*a* Shield housing open

The shield housing 125, like the shield housing 225 for a plug connector 100 or 200, is connected and clamped to the exposed shielding braid of the data line not shown here at its ends which face the data cable inlet, as shown in FIGS. 5*a* and 5*b*. This is reflected in the combination of FIGS. 5*a* and 5*b*. FIG. 5*a* shows the released state of the clamping, while FIG. 5*b* shows the latched and clamped state. For this purpose, the end facing the data line (not shown) of the shield housing 125 or 225, respectively, comprises a shoulder 127, which receives a U-shaped shield bracket 128, which snaps in during joining. For this purpose, the erect limbs of the "U" have latching openings 128.1 into which projecting latching cams 127.1 on the limbs of the shoulder 127 engage when the data cable is clamped, which fixates the clamping and ensures good contact-making. This will result in continuous secure shielding of the signal lines. This embodiment also provides the option to release the latched clamping at any time to install the shielded data line cut to size.

According to an advantageous embodiment, represented in FIGS. 4 and 5, the shield housing 125, the contact carrier receiving means 120, and the contact carrier 121 have an assembly orientation. The assembly orientation is configured as an arrow 129 on the contact carrier 121 and another arrow 129.1 on the shield housing 125. In the assembled state of the parts 121, 120, and 125, the arrow 129 engages in respective recesses 130 on the contact carrier receiving means 120 and on the shield housing 125 and latches into the recesses 130, while the arrow 129.1 engages in a recess 130.1 on the contact receiving means 115, shown in FIG. 3 in the assembled state of the parts.

Figure 6:
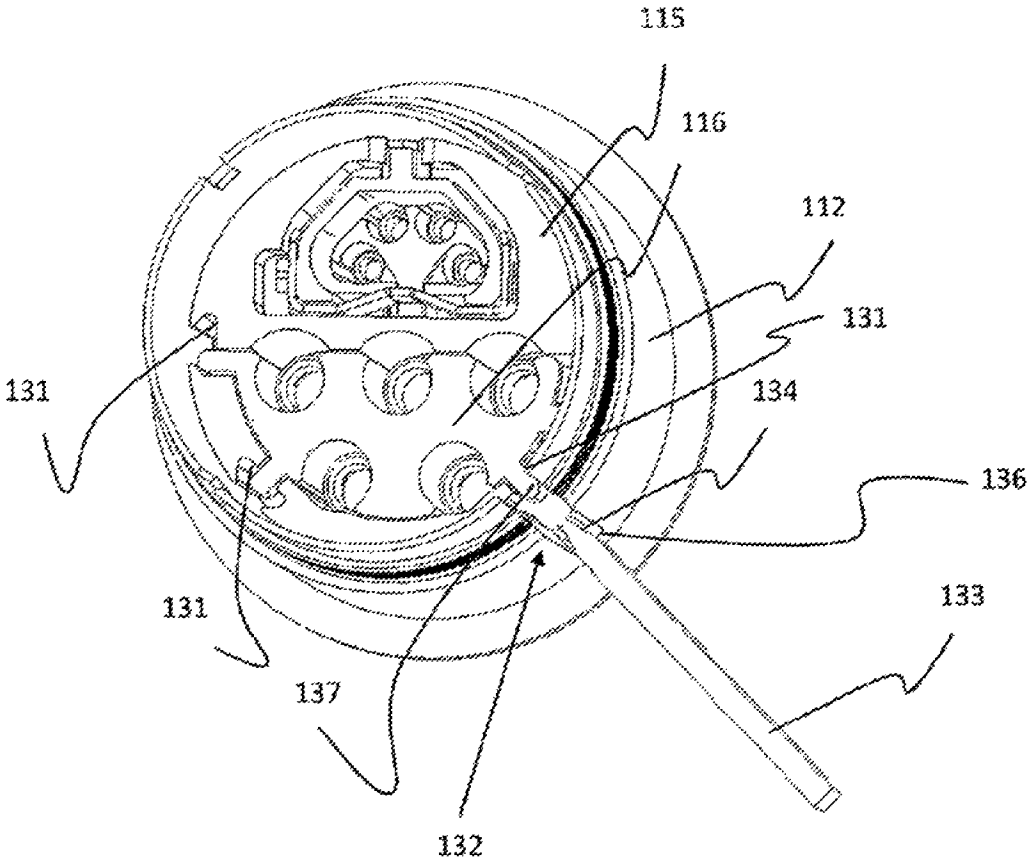
FIG. 6: shows a perspective view of a detail of the coding for assembling the contact carrier on the central part.

FIG. 6 shows another advantageous embodiment in a view according to the direction of view 300 represented in FIG. 3, which embodiment particularly provides a secure and error-free assembly of the plug connectors 100, 200. Grooves 131 care provided on the contact receiving means 115 for this purpose, which grooves interact with a connectible coding 132 on the contact receiving means 115 in the plugged-in state. The coding 132 consists of or comprises a web element 133 that can be connected to the contact receiving means 115, and which can be broken off at a predetermined breaking point 134 after the contact receiving means 115 has been inserted in the central part 112. The coding 132 can be slid into various grooves 131 on the central part 112, each resulting in a different angular position of the contact receiving means 115 to the shield housing 125. This results in four codings per contact arrangement which cannot be plugged into one another. The angular position of the contact receiving means 115 to the shield housing 125 is always the same and cannot be changed. The coding results in a different angular position of the components inserted in the central part 112 relative to the locking cams 111.1 for a plug connector 100 or relative to the locking grooves 211.1 for a plug connector 200.

The locking ring 111 and locking ring receiving means 211 can secure the plug connectors 100 and 200 in the plugged-in state using a bayonet or threaded lock, such that unintended disconnection is prevented.

According to FIGS. 3, 4, 5*a*, 5*b*, and 6, the assembly procedure for a plug connector 100 is as follows:

In a first step, the cable end not shown here is prepared, wherein the sheathing is removed on the free end of the cable, such that the power lines and the data lines are exposed together with the shielding braid. Then the plug sockets 117 of the power contacts are connected to the power lines, while the plug sockets 122 of the data contacts are connected to the data lines. The plug sockets 122 and connected data lines are then clipped into the contact carrier 121. Then the data carrier receiving means 120 in the form of a sleeve is slid onto the contact carrier 121 with the plug sockets 122 and secured by the locking lug 129 snapping into the recess 130 in the form of a guide sleeve, represented in FIG. 4.

The data carrier receiving means 120 is then slid in to the shield housing 125 and once again secured by the locking lug 129 snapping into the recess 130 according to FIG. 4. Due to a predetermined length of the data lines, the shielding braid is in alignment and flush with the shield housing 125, which forms a bowl. The shielding braid is connected to the metal shield housing 125 in an interlocking fit by hooking (see FIG. 5*a*) and clipping in (see FIG. 5*b*) the shield bracket 128. The cable inlet socket 113 is slid over the open cable end from the "front" until it rests on the cable sheath. Then the plug sockets 117 of the power contacts are clipped into the contact carrier 116 designed as an insulator body.

According to FIG. 6, the coding 132 is inserted in a groove 131 provided on the contact receiving means 115 and slid into it. The contact carrier 116 with the plug sockets 117 of the power contacts is slid into the contact receiving means 115, wherein on of the coding protective lugs 137 on the contact carrier 116 secures the slid-in coding 132 against falling out. The shield housing 125 described above is then also inserted in the contact receiving means 115 and secured using the locking element 129.1 from FIG. 5.

The contact receiving means 115, completely equipped with the shield housing 125 and the contact carrier 116, is then inserted based on the coding 132 and the associated visible web element 133 into the groove 136 on the central part 112 to determine the coding position of the mating interface.

The locking ring 111, which is designed as a bayonet sheath, is then connected to the central part 112 which forms the housing with the interposed sealing ring 114. Finally, the cable inlet socket 113 designed as a clamping ring is screwed onto the thread of the central part 112 to secure the entire interior of the plug connector 100.

LIST OF REFERENCE SYMBOLS

100 Plug connector
100' Plug connector
100" Plug connector
100'" Plug connector
110 Outer casing
111 Locking ring
111.1 Locking cams
112 Central part
113 Cable inlet sockets
114 Sealing ring
115 Contact receiving means
116 Contact carrier
116.1 Recess
117 Plug sockets/power contacts
120 Data carrier receiving means contact receiving means carrier
121 Contact carrier/contact insert
121.1 Recess
122 Plug sockets/data contacts
125 Shield housing
126 Shoulder
127 Shoulder
127.1 Latching cam
128 Shield bracket.
128.1 Latching openings
129 Locking lug/arrow
129.1 Further arrow on the shield housing
130 Recesses
130.1 Recess
131 Grooves
132 Coding
133 Web element
134 Predetermined breaking point
135 Rib
136 Groove
137 Coding protective lug
200 Plug connector
210 Outer casing
211 Locking ring receiving means
211.1 Locking groove
212 Central part
213 Cable inlet sockets
215 Contact receiving means
217 Plug pins
222 Plug pins
225 Shield housing
226 Collar
300 Direction of view

The invention claimed is:

1. A hybrid plug connector for connecting conductor cables of different electronic modules to insulator bodies arranged in an outer casing for receiving a power conductor transmitting a power supply and a shielded data conductor for data transmission for transmitting signals/data of an industrial bus, wherein the power conductor has at least two power lines and the data conductor has at least one data line, wherein the power lines and the data lines are guided in contact parts designed as plugs or sockets and can be coupled via these contacts parts, and wherein the outer casings of the hybrid plug connectors designed as socket or as plug can be joined inside one another for interlocking coupling, and wherein an insulator body designed as a contact carrier receiving means is arranged in each of the plug connectors designed as sockets and plugs, having a contact carrier in a shield housing, the shield housing accommodating a contact carrier which carries forward the data line(s) designed as plug sockets or plug pins in a shielded manner in the plug connector designed as socket or plug, and wherein the couplable contacts form a shape-encoded interlocking connection in the plugged-in state of the connection, wherein the plug sockets or plug pins of the data lines can be inserted with an interlocking fit into recesses of a contact carrier, which is disposed in a trapezium-shaped contact carrier receiving means, and the contact carrier receiving means is equipped with a shield housing which surrounds the contact carrier receiving means in an interlocking fit and carries forward the shielding of the data lines, the free end of which shield housing is either designed as a shoulder or as an overlapping collar for coupling the plug connectors designed as sockets and as plugs.

2. The hybrid plug connector according to claim 1, wherein the contact carrier receiving means is designed such that it can be slid into the shield housing with the data lines.

3. The hybrid plug connector according to claim 1, wherein the shield housing can be clamped onto the contact carrier receiving means in the slid-on state.

4. The hybrid plug connector according to claim 1, wherein a shield bracket is disposed on the shield housing for clamping onto the contact carrier receiving means which receives the data line, which bracket can be releasably latched or locked for clamping to the shield housing.

5. The hybrid plug connector according to claim 4, wherein the shield bracket comprises a latching opening which secures the clamping interacting with a latching cam on the shield housing.

6. The hybrid plug connector according to claim 1, wherein the shield housing, the contact carrier, and the contact carrier receiving means have an assembly orientation.

7. The hybrid plug connector according to claim 6, wherein the assembly orientation is configured as an arrow which snaps into recesses on the contact carrier receiving means and the shield housing in the assembled state of the parts.

8. The hybrid plug connector according to claim 1, wherein the plug connector designed as a plug or socket includes a central part which comprises at least one groove which interacts with a coding on the contact receiving means for the contact carrier with the power contacts in the plugged-in state.

9. The hybrid plug connector according to claim 8, wherein the coding comprises a web element which can be connected to the contact receiving means, which element can be broken off after the contact receiving means has been inserted in the central part.

10. The hybrid plug connector according to claim 1, wherein the connection of the plug connectors designed as sockets or plugs is secured using a bayonet or threaded lock.

11. The hybrid plug connector according to claim 1, wherein the plug housings of the plug connectors have a modular structure allowing implementation in various designs without requiring different tools.

12. The hybrid plug connector according to claim 1, wherein the data conductors comprise copper or optical waveguides.

* * * * *